US005485918A

United States Patent [19]

Lasenby et al.

[11] Patent Number: 5,485,918

[45] Date of Patent: Jan. 23, 1996

[54] PACKAGING ASSEMBLY

[75] Inventors: Kyle D. Lasenby, Eagan; Barry S. Peecher, Vadnais Heights, both of Minn.

[73] Assignee: Minnesota Mining and Manufacturing Company, St. Paul, Minn.

[21] Appl. No.: 276,763

[22] Filed: Jul. 18, 1994

Related U.S. Application Data

[63] Continuation of Ser. No. 787,380, Nov. 4, 1991, abandoned.

[51] Int. Cl.[6] ..... B65D 5/50

[52] U.S. Cl. ..... 206/372; 206/485; 206/489; 206/589

[58] Field of Search ..... 206/485, 486, 206/488, 489, 349, 372, 45.19, 588, 589; 229/120.15, 120.18

[56] References Cited

U.S. PATENT DOCUMENTS

| | | | |
|---|---|---|---|
| D. 132,201 | 4/1942 | Slough . | |
| D. 160,015 | 11/1948 | Rauch et al. . | |
| 888,026 | 5/1908 | Moore | 206/486 |
| 1,246,940 | 11/1917 | Safford . | |
| 2,238,451 | 4/1941 | Roth . | |
| 2,256,995 | 9/1941 | Andres | 206/485 X |
| 2,286,208 | 6/1942 | Kirchner . | |
| 2,620,962 | 12/1952 | Powell | 206/485 |
| 2,794,303 | 6/1957 | Wickes . | |
| 2,813,633 | 11/1957 | Welling . | |
| 2,918,178 | 12/1959 | Leone . | |
| 2,929,498 | 3/1960 | McCormick et al. . | |
| 2,991,596 | 7/1961 | Walters . | |
| 2,997,164 | 8/1961 | Rue, Jr. | 206/372 |
| 3,013,668 | 12/1961 | Mennen . | |
| 3,082,582 | 3/1963 | Jeske . | |
| 3,630,349 | 12/1971 | Rechberger | 206/372 |
| 3,849,949 | 11/1974 | Steinhauser et al. . | |
| 3,875,703 | 4/1975 | Clemente . | |
| 3,912,142 | 10/1975 | Steinhauser et al. . | |
| 3,924,362 | 12/1975 | McAleer . | |
| 4,025,039 | 5/1977 | Croll et al. | 206/485 |
| 4,126,229 | 11/1978 | Sheres . | |
| 4,485,922 | 12/1984 | Desmond et al. | 206/485 |
| 4,609,581 | 9/1986 | Ott . | |
| 4,667,447 | 5/1987 | Barton . | |
| 4,746,010 | 5/1988 | Fournier . | |
| 4,896,820 | 1/1990 | Harrington . | |
| 4,951,813 | 8/1990 | Sauter | 206/486 X |
| 5,002,188 | 3/1991 | Dickie | 206/589 |
| 5,040,340 | 8/1991 | Bischof et al. . | |
| 5,121,838 | 6/1992 | Dickie | 206/485 X |

OTHER PUBLICATIONS

"Fibre Box Handbook", Stone Container Corporation, Corrugated Container Division, 1987.

*Primary Examiner*—Jacob K. Ackun

*Attorney, Agent, or Firm*—Gary L. Griswold; Walter N. Kirn; Jeffrey J. Hohenshell

[57] ABSTRACT

According to the present invention there is provided a packaging assembly for enclosing and protecting a plurality of back-up pads having a generally disc or frusto-conically disc shaped resilient portion. The packaging assembly comprises an elongate bottom box portion comprising three axially elongate bottom side walls. The bottom side walls form an elongate main portion of the bottom box portion. The package assembly also includes a pair of bottom end walls disposed generally radially of the bottom box portion axis. A rack portion having first and second holding walls is present. The rack portion is disposed adjacent the elongate main portion of the bottom box portion and has a plurality of spaced surfaces forming slots corresponding to the shape of a back-up pad. The surfaces forming the slots are adapted to engage the surfaces of the back-up pads to retain a spaced relationship between back-up pads in the assembly. A top cover for enclosing the elongate main portion of the bottom box portion is also present to further protect the back-up pads.

20 Claims, 7 Drawing Sheets

PACKAGING ASSEMBLY

This is a continuation of application Ser. No. 07/787,380 filed Nov. 4, 1991, now abandoned.

TECHNICAL FIELD

The present invention relates generally to packaging systems for enclosing, transporting and displaying back-up pads for use with abrasives.

BACKGROUND

Back-up pads for sheets of coated abrasive are well known in the art and are used in a variety of sanding, grinding and polishing operations such as auto body repair and refinishing, woodworking, and metalworking. As used herein, the phrase "coated abrasive" means an article having a backing and a plurality of abrasive grains bonded thereto. The abrasive grains may include grains adapted for polishing or buffing a workpiece. Examples of back-up pads and abrasive sheets are disclosed in U.S. Pat. Nos. 2,991,596; 3,082,582; 3,875,703 and 3,924,362 the entire contents of which are herein incorporated by reference.

As used herein the phrase "back-up pad" means an article generally comprising a resiliently compressible portion (e.g. constructed from an elastomer or foam such as polyurethane foam) having a front surface (e.g. circular) and a rear surface (e.g. circular). For example, some back-up pads include attachment means adjacent the rear surface which may comprise a recessed or post screw portion for attaching the back-up pad to a rotative source of power such as a random orbital sander (e.g. the sander disclosed in Bischof et al. U.S. Pat. No. 5,040,340 the entire contents of which are herein incorporated by reference), a hand or manually driven tool (e.g. the hand driven tool described in U.S. Pat. No. 2,794, 303 the entire contents of which are herein incorporated by reference) or a dual action (DA) type sander. Back-up pads are generally available from the Minnesota Mining and Manufacturing Co. of St. Paul, Minn. under the trade names Hookit™ and Stikit™.

An abrasive (e.g. the abrasive discs described in U.S. Pat. Nos. 3,849,949 and 3,912,142 the entire contents of which are herein incorporated by reference) may be attached to the front surface of the back-up pad by a variety of attachment means. In U.S. Pat. No. 2,286,208 (the entire contents also incorporated by reference), a coated abrasive sheet is attached to a back-up pad by a coating of pressure sensitive adhesive. Another approach is to have loops that project from the abrasive sheet (as described in U.S. Pat. No. 4,609,581 herein incorporated by reference) and hooks that project from the front surface of the back-up pad. Yet another approach is to use the magnetic attachment described in Barton U.S. Pat. No. 4,667,447, the entire contents of which are also herein incorporated by reference.

During storage, transportation and display of back-up pads, it is important to protect the back-up pads, particularly the resilient portion of a back-up pad. A torn, punctured, dented, split, cracked, ripped or otherwise deformed resilient portion may mar or cause a deep, damaging scratch in a workpiece.

Back-up pads which include an attachment means comprising a male screw portion tend to be particularly susceptible to damage from, for example, the male screw portion of one pad damaging the front surface of another back-up pad. Damage to the front surface of a back-up pad may lead to a variety of undesirable results such as, for example, damage to the means for attaching an abrasive to the back-up pad, and a loss of pad weight balance resulting in rotational instability in a back-up pad used in conjunction a with rotative source of power.

FIG. 1 illustrates a portion of a packaging system typically used to enclose and protect a back-up pad. That system utilizes an opaque, relatively durable paper or chipboard sleeve 2 to wrap the resilient portion of the back-up pad. Indicia may be printed on the sleeve 2. Each pad is individually wrapped, and then a plurality of the wrapped back-up pads are typically placed or stacked in a box for subsequent transportation or storage.

The prior art packaging system shown in FIG. 1 suffers from many drawbacks including expense. Further, in order to view the back-up pad, the paper or cardboard sleeve 2 has to be removed. Additionally, as each wrapped pad is removed from the box used in the prior art system, the remaining pads tend to become haphazardly arranged in the box which (1) does not provide a desirable presentation of the product for sellers, vendors or other users, and (2) may result in damage to the remaining back-up pads.

Other packaging systems comprise a box having alternating layers of back-up pads and sheets of corrugated board. Again, such systems suffer from many drawbacks including expense and lack of visibility of the back-up pads.

DISCLOSURE OF THE INVENTION

The present invention is directed to a packaging system for effectively and efficiently enclosing, protecting and displaying a plurality of disc or frusto-conical disc shaped elements which: (1) may be displayed horizontally or vertically, (2) may include a tab that may be displayed in either the horizontal or vertical configuration, (3) continuously presents and displays the back-up pads in an orderly, aesthetically pleasing manner even after some of the pads have been removed, (4) surrounds each of the back-up pads with a cushion of air, and (5) prevents a male screw thread portion of one pad from damaging another back-up pad in the assembly.

According to the present invention there is provided a packaging assembly for enclosing and protecting a plurality of back-up pads having a generally disc or frusto-conically disc shaped resilient portion, a circular front surface adapted to have abrasive means attached thereto, and a circular rear surface with structure adjacent thereto that is adapted to attach the back-up pad to a source of power. The packaging assembly comprises an elongate bottom box portion having a longitudinal axis comprising three axially elongate bottom side walls each having inside and outside surfaces, opposite first and second ends and opposite edges.

Each of the bottom side walls are attached along at least one of its edges to the edge of another of the side walls to form an elongate main portion of the bottom box portion. The package assembly also includes a pair of bottom end walls disposed generally radially of the bottom box portion axis and attached adjacent the first and second ends of the side walls.

A rack portion having first and second holding walls is present. The rack portion is disposed adjacent the elongate main portion of the bottom box portion and has a plurality of spaced surfaces forming slots corresponding to the shape of a back-up pad. The surfaces forming the slots are adapted to engage the surfaces of the back-up pads to retain a spaced relationship between back-up pads in the assembly.

Top cover means for enclosing the elongate main portion of the bottom box portion are also present to further protect the back-up pads.

According to a first embodiment of the present invention, the first and second holding walls have edges and the rack portion comprises a package insert. The insert comprises the first and second holding walls and includes a pair of side flaps each having a pair of ends and edges. The flaps are foldable between a first protection position with first major surfaces of the flaps facing each other to form a generally W-shaped insert, and a second display position with the first major surface of one flap facing a second major surface of the other flap to form a generally elongate structure with a longitudinal axis and a generally triangular cross-section that is adapted to display the back-up pads in a horizontal position.

One of the flaps has a pair of slits to form a locking tab, and the other flap has a pair of locking slots. When the flaps are folded to the display position, the locking tabs may be bent to engage the locking slot to lock the flaps in the display position.

Optionally, the first embodiment of packaging assembly may include a means for displaying the insert in a vertical position comprising each of the flaps having holes. Also optionally, one of the flaps may have slits forming a foldable indicator member comprising a base portion and an indicia portion. When the flaps are folded to the second display position, the indicator member may be folded between a vertical display position and a horizontal display position.

According to a second embodiment of packaging assembly according to the present invention, the first and second holding walls have a pair of opposite edges and the rack portion comprises a tuck flap having a pair of edges. The first and second holding walls are joined to an edge of one of the bottom side walls along one of their edges, and are joined to the tuck flap along the other of their edges. The tuck flap is adapted to frictionally engage an inner surface of one of the bottom side walls.

The three bottom side walls are disposed such that two are generally parallel to each other and one is perpendicular to the parallel bottom side walls. The pair of bottom end walls each comprise a pair of end flaps each attached to the ends of the parallel bottom end walls, and a foldable fastening flap attached to the end of the bottom side wall that is perpendicular to the parallel bottom side walls. The fastening flap is foldable to enclose the pair of end flaps. The fastening flap has a tab at one end that is adapted to engage a notch in a bottom side wall to lock the bottom end wall in place.

In the second embodiment of packaging assembly, the top cover means comprises a box slightly larger than the bottom box portion and may optionally include a length of pressure sensitive tape attached to the top cover box the elongate bottom box portion.

BRIEF DESCRIPTION OF THE DRAWINGS

The present invention will be further described with reference to the accompanying drawing wherein like reference numerals refer to like parts in the several views, and wherein.

DETAILED DESCRIPTION

Figure 1:
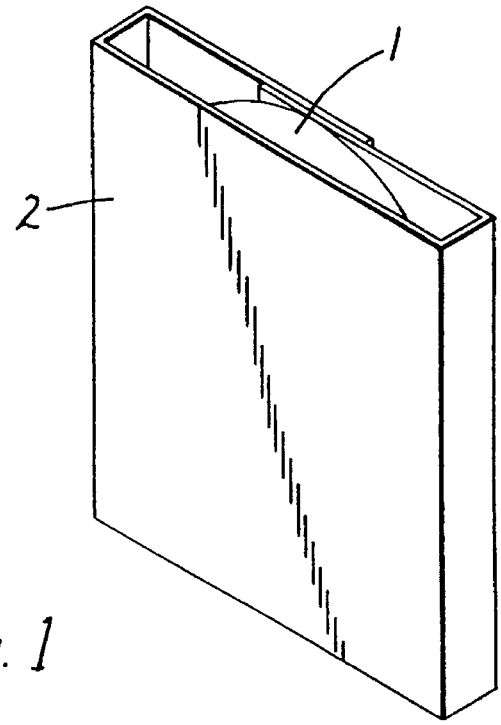
Fig. 1 PRIOR ART
FIG. 1 is a perspective view of portions of a prior art back-up pad packaging system and illustrates a sleeve used to wrap a back-up pad.

Referring now to FIGS. 2 through 6 of the drawing, there is shown a first embodiment of packaging assembly according to the present invention generally designated by the reference numeral 10.

Figure 1A:
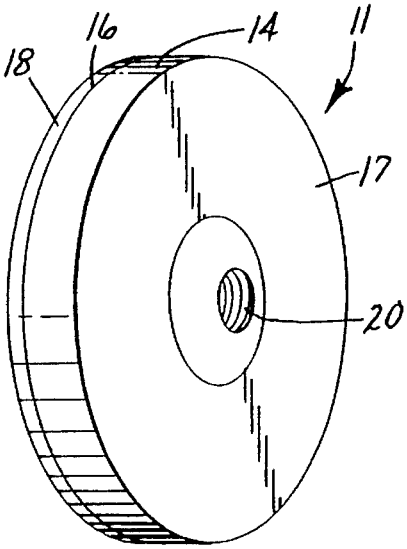
FIG. 1A is a perspective view of a first example of back-up pad illustrating the rear portion of the pad.
Figure 1B:
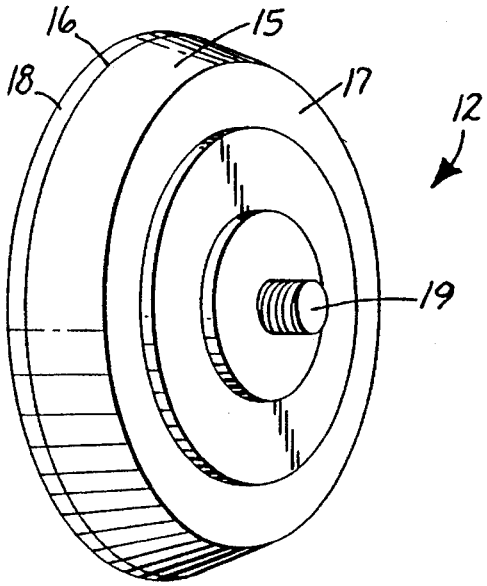
FIG. 1B is a perspective view of a second example of back-up pad illustrating the rear portion of the pad.

The packaging system 10 is adapted to enclose, protect and display a plurality of back-up pads such as, for example, the back-up pads 11 and 12 shown in FIGS. 1A and 1B respectively. FIG. 1B represents a back-up pad 12 from the Stikit™ brand system generally available from the Minnesota Mining and Manufacturing Co. (3M) of St. Paul, Minn. Optionally the back-up pad may be a pad from the Hookit™ brand system also generally available from the Minnesota Mining and Manufacturing Co. (3M) of St. Paul, Minn.

The back-up pad 12 comprises a generally frusto-conically (FIG. 1B) disc shaped resiliently compressible portion 15 (e.g. a resiliently compressible foam constructed from, for example, polyurethane foam), and a generally circular front surface 16 adapted to have abrasive means 18 attached thereto. The back-up pad 12 also includes a generally circular rear surface 17 with structure (e.g. male screw member or post 19) adjacent thereto that is adapted to attach the back-up pad 11 to a source of power such as a random orbital sander or a manually powered hand block.

Another example of a back-up pad is shown in FIG. 1A and is generally designated by numeral 11. The back-up pad 11 is similar to the back-up pad 12 except that the pad 11 includes a generally disc shaped resilient portion 14, and includes a recessed screw portion 20 for attaching the back-up pad 11 to a source of power. Generally, as used herein, the phrase disc-shaped refers to the shape of the resilient portion 14 of FIG. 1A and also to frusto-conically disc shaped resiliently compressible portion 15 of FIG. 1B.

According to the present invention there is provided a packaging assembly 10 comprising an elongate bottom box portion 22 having a longitudinal axis comprising three axially elongate bottom side walls 23, 24, 25 each having inside 26 and outside 27 surfaces, opposite first 28 and second 29 ends and opposite edges 30, each of the bottom side walls 23, 24 or 25 being joined along at least one of its edges 30 to the edge 30 of another of the side walls 23, 24 or 25 to form a tubular or elongate main portion 32 of the bottom box portion 22. The bottom box portion 22 also includes a pair of bottom end walls 34 disposed generally radially of the bottom box portion axis and attached adjacent the first 28 and second 29 ends of the side walls 23, 24 and 25. The edges 30 of bottom side wall 24 may be formed by any means readily known in the art such as, for example, by perforation or crush scores.

The packaging assembly 10 also includes a rack portion 40 having first 41 and second 42 holding walls preferably disposed at an angle relative to one another and disposed at an angle relative to the side walls 23, 24 and 25 of the bottom box portion 22. The rack portion 40 is situated within the tubular or elongate main portion 32 of the bottom box portion 22 and may be manually removed therefrom for ready access and display of the back-up pads.

The rack portion 40 has a plurality of spaced surfaces forming slots 44 corresponding to the shape of a back-up pad (e.g. 12). For example, the slots 44 may be constructed in the shape shown in FIGS. 5 and 6, but may be constructed in any suitable shape (e.g. polygonal, rectangular, square, arcuate, circular, elliptical or combinations of these shapes) so long as the slots frictionally engage the surfaces of the back-up pads (e.g. 12) to retain a spaced relationship between back-up pads 11 in the assembly 10 and between the back-up pads 11 and the elongate bottom box portion 22 (note FIG. 3). The shape of the slots 44 shown in FIG. 6 illustrate that the slots are preferably flared or enlarged at their edges to protect the edges of the back-up pads. Also, the middle portion of the slots may be partially enlarged to further facilitate proper engagement between the back-up pad and the slot 44.

Figure 6A:
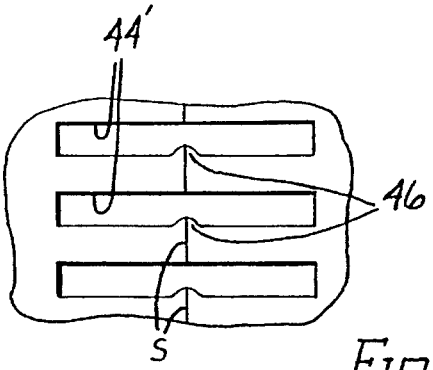
FIG. 6A is an elevational view of a flat blank having a different slot configuration than the slot shown in FIG. 6 and with portions broken away to show detail.
Figure 4A:
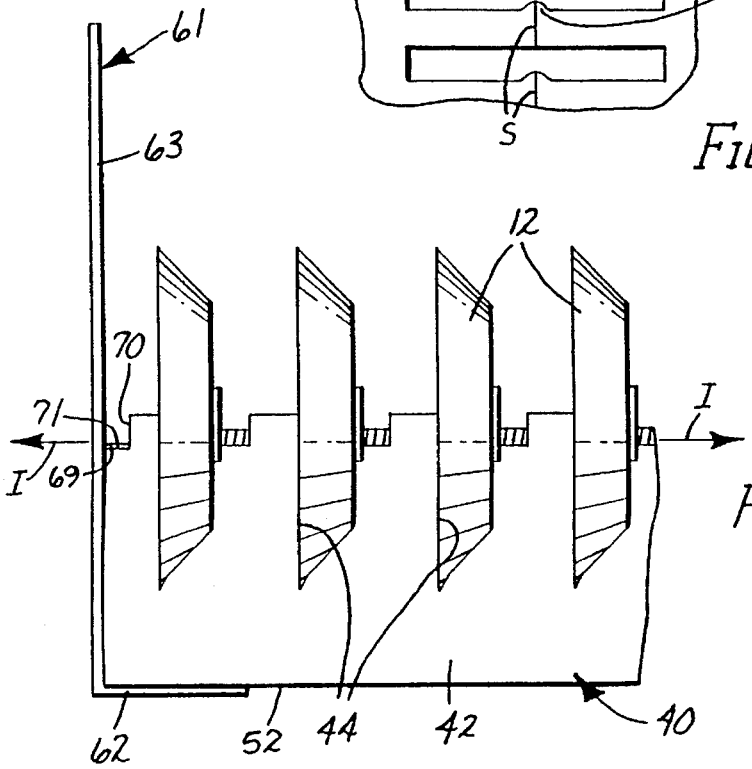
FIG. 4A is an enlarged side elevational view of the insert of FIG. 4 with portions broken away and illustrating the indicator in a horizontal display position.
Figure 6:
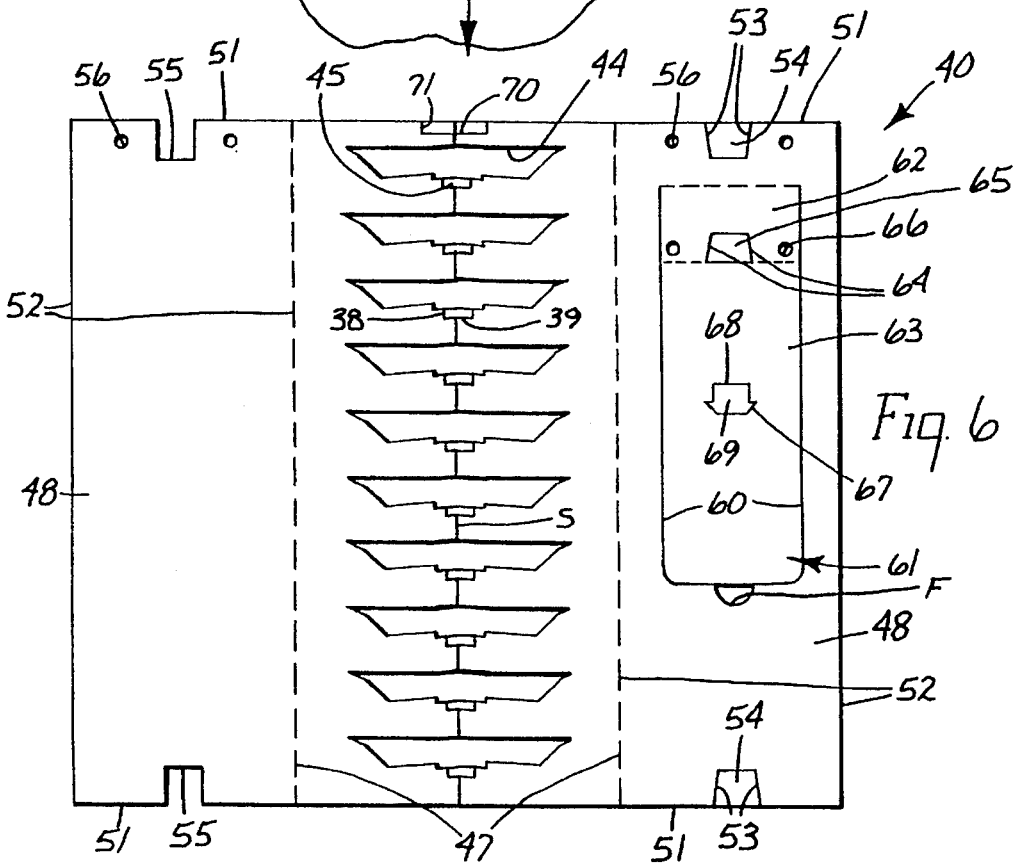
FIG. 6 illustrates a flat blank from which an insert included in the package assembly of FIG. 2 is assembled.

FIGS. 6 and 6A illustrate examples of slots 44 and 44'. The slots 44 and 44' are generally symmetrical about axial score or perforation line S that is generally midway between edges 47 of holding walls 41 and 42. The slot 44 shown in FIG. 6 includes a notch portion 45 which is adapted for use with a back-up pad such as the back-up pad 12 shown in FIG. 1B which includes a post screw portion 19. The notch portion 45 may be constructed by a pair of small score lines 38 extending generally parallel to score line S and a small slit 39 extending between the score lines 38. When the rack portion 40 is bent into the shape shown in FIGS. 3 and 4, the structure between the score lines 38 may be bent into a V-shape to form a groove for insertion of the post or male screw portion (e.g. 19) of the back-up pad 12 (FIG. 4A).

While the slit 39 is shown in FIG. 6 as a straight line, optionally, the slit 39 may comprise two segments at an angle with each other so that the slit 39 and the score lines 38 form a generally W-shape (not shown). In this embodiment of slot (not shown), when the rack portion is bent to the shape shown in FIG. 4 and back-up pads 12 are inserted into slots 44, a portion of the holding walls 41 and 42 will cover the male screw portion 19 and act as a barrier to prevent the back-up pad 12 from being inadvertently removed from the slot 44.

Alternatively, the slot 44' which includes lip portion 46 shown in FIG. 6A may be used with the back-up pad 11 shown in FIG. 1A so that the lip portion 46 may extend into the passage formed by recessed screw portion 20. The lip portion 46 engages the portion 20 to prevent the back-up pad 11 from inadvertently disengaging from slot 44'. Also, optionally the slot 44' may be shaped so that it is larger near its end portions than it is near its middle portion.

Top cover means 5 for enclosing the tubular or elongate main portion 32 of the bottom box portion 22 comprise a plurality of cover panels 6 attached along an edge 30 of bottom side walls 23 and 25 and attached along an edge of bottom end walls 34. The cover panels 6 may be closed by using a length of pressure sensitive adhesive (not shown). Alternatively, a length of tear tape may be used as a means for opening the assembly 10.

Figure 2:
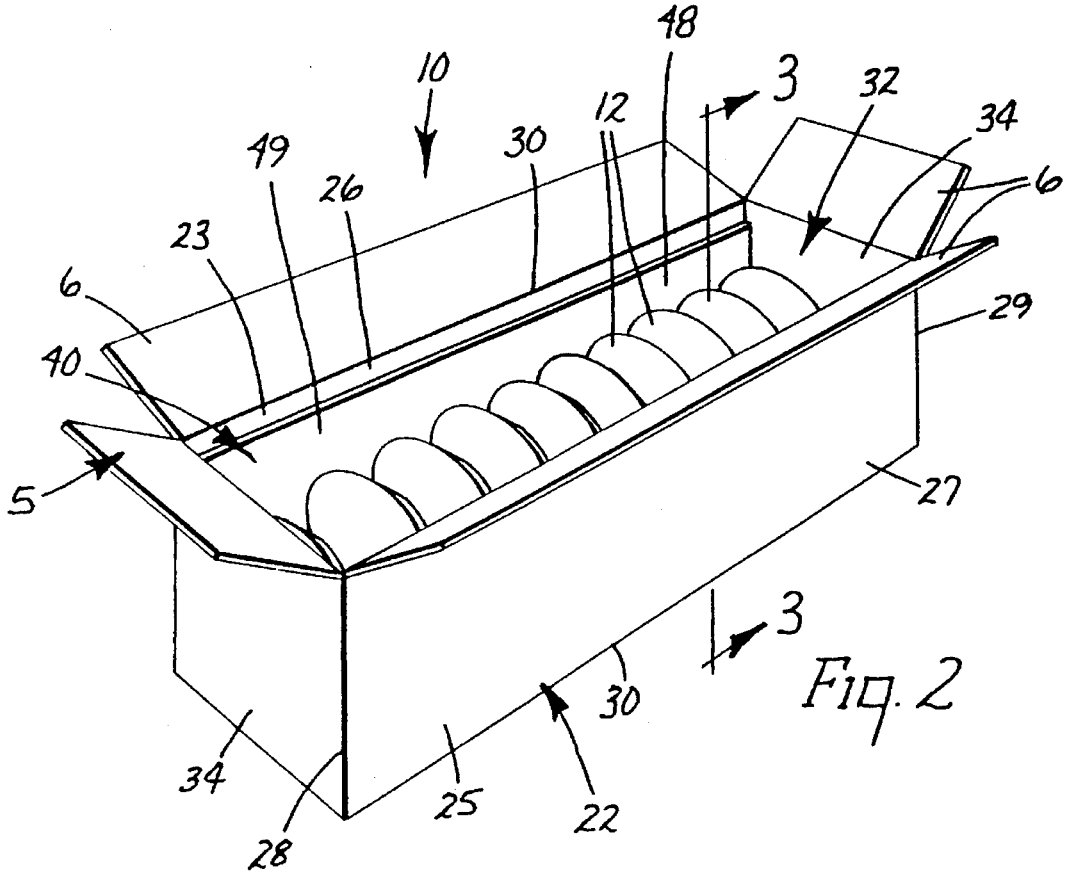
FIG. 2 is a perspective view of a first embodiment of packaging assembly according to the present invention with the top open.
Figure 3:
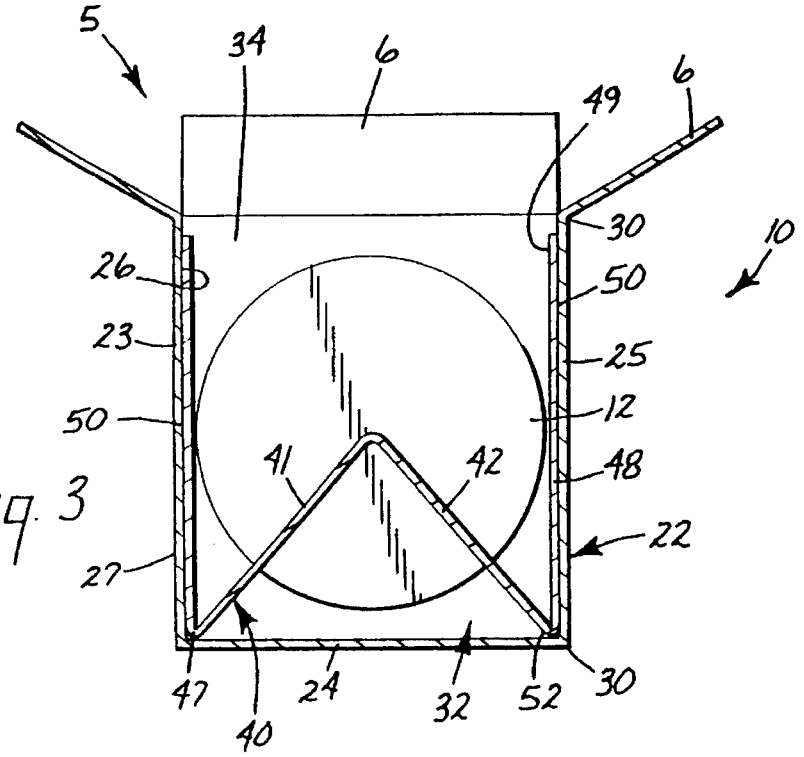
FIG. 3 is an enlarged cross-sectional view taken approximately along line 3—3 of FIG. 2.
Figure 4:
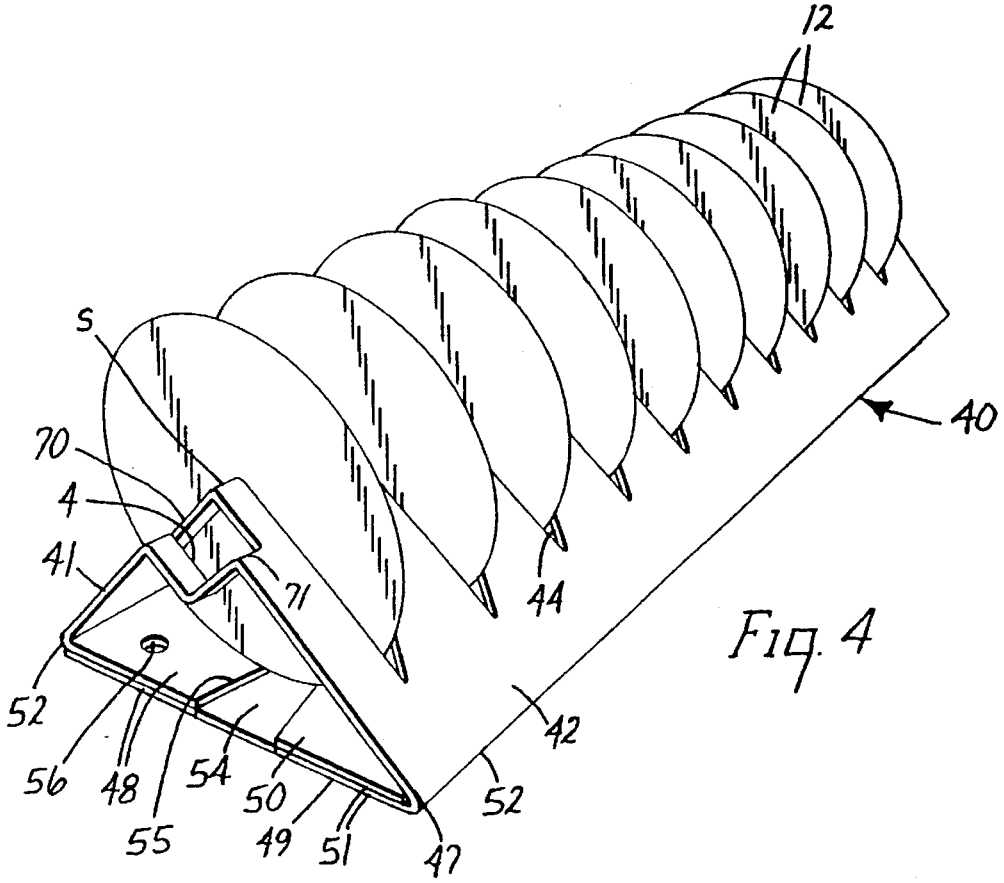
FIG. 4 is an enlarged perspective view of portions of the packaging assembly of FIG. 2 illustrating an insert displaying back-up pads in a horizontal position.
Figure 5:
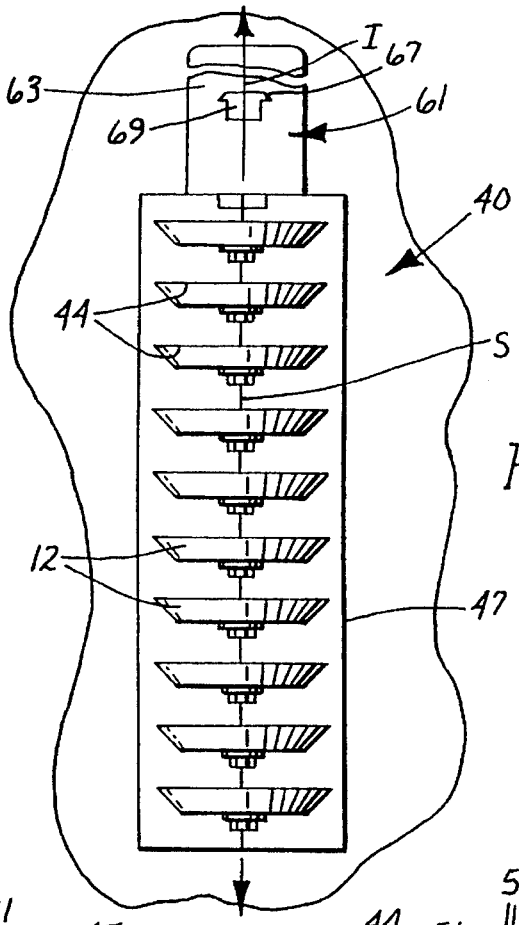
FIG. 5 is an enlarged elevational view of the insert of FIG. 4 displaying the back-up pads in a vertical orientation.

In the embodiment of package assembly 10 shown in FIGS. 2 through 6, the first 41 and second 42 holding walls have edges 47 and the rack portion 40 comprises a package insert adapted to be disposed within the tubular or elongate main portion 32 of the bottom box portion 22. The package insert is best seen in FIGS. 4 through 6 and comprises the first 41 and second 42 holding walls joined along score line S. The package insert includes a pair of side flaps 48 each having first 49 and second 50 opposite major side surfaces, a pair of ends 51 and edges 52. The flaps 48 are joined to one of the first 41 and second 42 holding walls along one of its edges 52.

The flaps 48 are foldable between a first protection position (FIGS. 2 and 3) with the first major surfaces 49 of the flaps 48 facing each other to form a generally W-shaped insert, and a second display position (FIG. 4) with the first major surface 49 of one flap facing the second major surface 50 of the other flap to form a generally elongate structure with a longitudinal axis I and a generally triangular cross-section that is adapted to present and display the back-up pads (e.g. 12) to potential users. In the orientation shown in FIG. 3, the flaps 48 protect the back-up pads 12 from damage by for example, separating the back-up pads from the bottom box portion 22 and by providing a cushion of air surrounding each pad 12.

The package insert used to form the rack portion 40 may be manually removed from the bottom box portion 22 and then used to display the back-up pads 12 either in a horizontal (FIG. 4) or a vertical (FIG. 5) orientation. One of the flaps 48 has a pair of angled slits 53 adjacent a middle portion of each of its ends 51 to form a locking tab 54, and the other flap has a pair of locking slots 55 adjacent a middle portion of each of its ends 51. When the flaps 48 are folded to the display position, the locking tabs 54 may be bent to engage the locking slots 55 to lock the flaps 48 in the display position. The flaps 48 may then be used as a base for the triangular shaped rack portion 40 to display the back-up pads 12 in the horizontal position.

Optionally, the package assembly 10 may include means for displaying the insert a vertical position comprising each of the flaps 48 having a pair of holes 56 extending between the first 49 and the second 50 major side surfaces generally adjacent one of their ends 51. The holes 56 may be used to engage hanging means such as hooks (not shown) to display the back-up pads 12 in the vertical position such as, for example, on a retail sales exhibit.

Another optional feature of the packaging system 10 comprises one of the flaps 48 having slits 60 forming a universal foldable indicator member 61 comprising a base portion 62 and an indicia portion 63. The indicia portion 63 of the indicator member 61 is adapted to have indicia printed thereon, such as a back-up pad product description, advertising or price information. The blank may include a finger hole F to afford access to the indicator member 61.

When the flaps 48 are folded to the second display position (e.g. FIGS. 4 and 5), the indicator member 61 may be folded between a vertical display position (FIG. 5) with the indicator member 61 generally parallel to the axis I of the insert and a horizontal display position (FIG. 4A) with the base portion 62 generally parallel to the axis I and the indicia portion 63 generally perpendicular to the axis I.

The indicator member 61 includes means for retaining the indicator member in the vertical (FIG. 5) or horizontal (FIG. 4A) display position comprising the base portion 62 having slits 64 forming a base portion tab 65 that is adapted to engage the locking slot 55 of one of the flaps 48. Optionally, the base portion 62 may also include holes 66 which cooperate with holes 56 to hang the package assembly 10 in the vertical position.

The means for retaining indicator member 61 in the horizontal display position (FIG. 4A) comprises the indicia portion 63 having slits 67 and score or perforation 68 defining an indicator member locking tab 69. The means further comprises the first 41 and second 42 holding walls having a slit 70 and a bend scores 71 for forming a rack locking slot 4 (FIG. 4). The indicator member locking tab 69 may be bent along score 68 so that it engages the rack locking slot 4 formed by bending the portion of the first and second holding walls 41 and 42 between scores 71. When the tab 69 is engaged with slot 4 the indicator member 61 will be retained in the horizontal display position.

EXAMPLE 1

Portions of the packaging assembly 10 shown in FIGS. 2 through 4 may be assembled from the blank shown in FIG. 6. The material used to construct the blank comprises a Kraft fiber material e.g. #200 Mullen strength, single wall corrugated board material (also known as Double Face) having a B type "flute" or corrugation with about 47±3 flutes per foot with each flute approximately 3/32 inches in height. Other appropriate materials are discussed in "Fibre Box Handbook, An Illustrated Reference for Manufacturers and Users of Shipping Containers," generally available from the Stone Container Corporation, Corrugated Container Division (Fibre Box Association, 1987) the entire contents of which is herein expressly incorporated by reference.

The blank has an overall axial length of approximately 17 and 1/16 inches, and an overall width of about 19.25 inches (48.9 centimeters). The side flaps each have a width of about 5 and 9/16 inches (14.1 centimeters), and each of the holding walls 41 and 42 have a width of approximately 4 and 1/16 inches (10.3 centimeters). The indicator member 61 may be approximately centered on flap 48 and have a width of approximately 3.5 inches, and a length of about 9 and 13/16 inches.

To form the shape of the insert shown in FIG. 3, the blank may be bent along score line S and along perforations along edges 47. Optionally the perforations along edges 47 may comprise crush score lines. The slots 44 or 44' are cut in the shape according to the shape of back-up pad (e.g. 11 or 12). For example, the slot 44 may have an outer diameter of about 5 and 5/8 inches and an inner diameter of about 3 and 3/4 inches, and an inner width of about 0.69 inches. The slits or perforations may be machined into the blank by methods readily known in the art.

After the blank is bent into the shape shown in FIG. 3, the insert may be placed inside the elongate bottom box portion 22 which includes an inner length of about 17.187 inches, an inner width of about 5.25 inches and, and a height of approximately 5.625 inches.

Several Stikit™ Nylon Face 5 inch Disc Pads having a male screw portion, Part No. 81821 generally available from Minnesota, Mining and Manufacturing Co. of St. Paul, Minn. may be used in conjunction with the blank described in this example.

Figure 7:
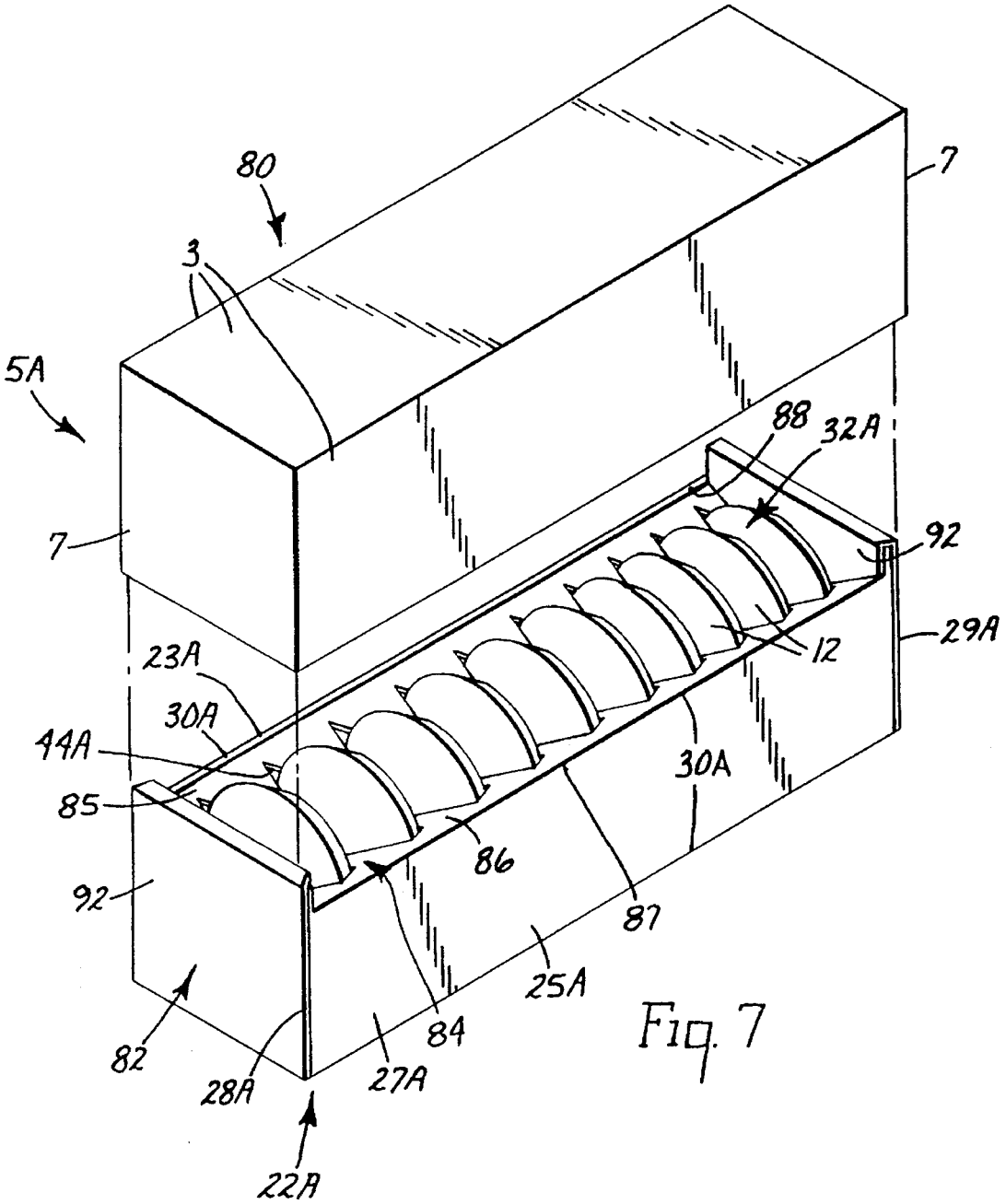
FIG. 7 is a perspective view of a second embodiment of packaging assembly according to the present invention which illustrates a top and bottom portion of a box.
Figure 8:
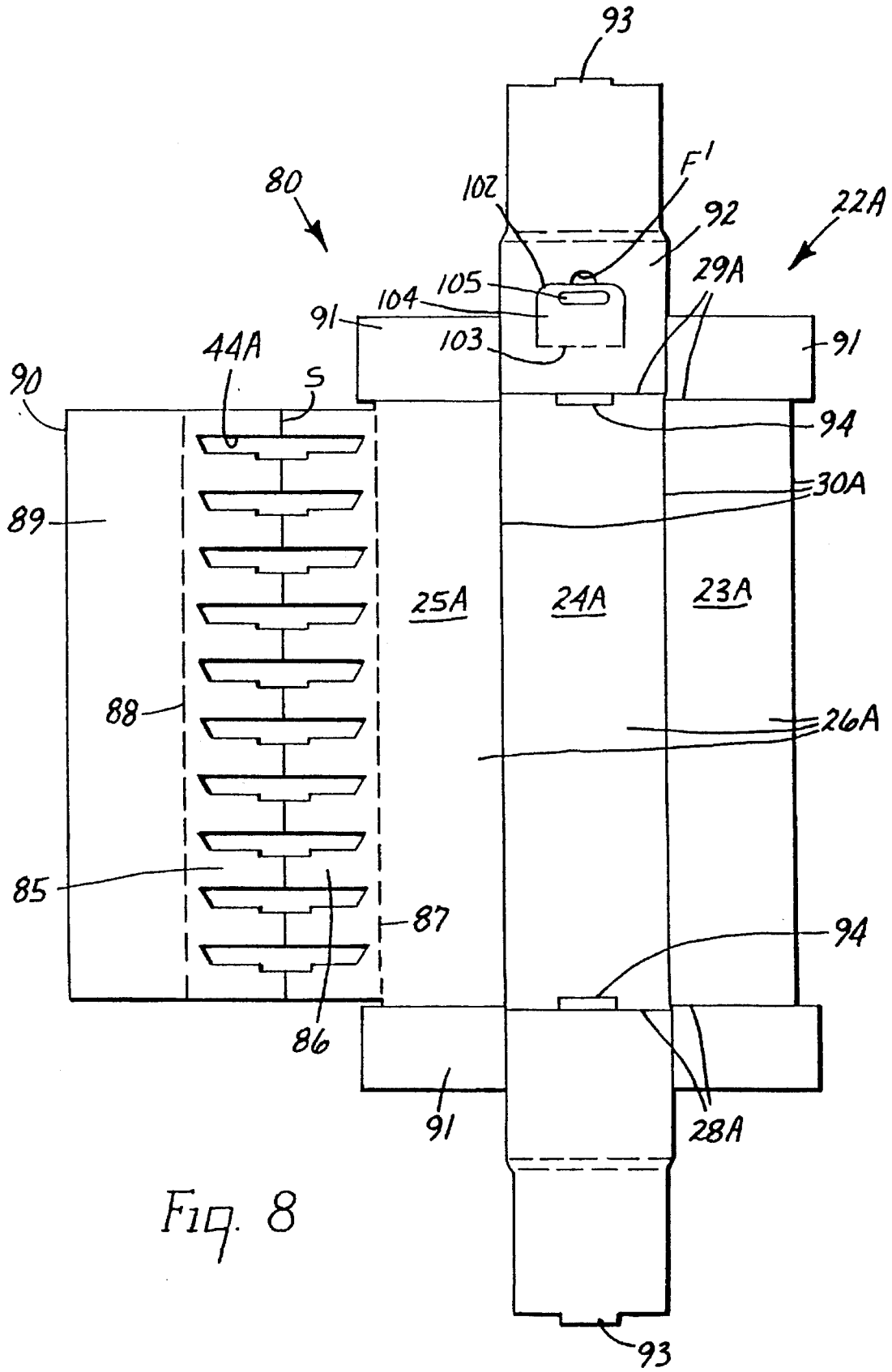
FIG. 8 illustrates a flat blank from which the bottom portion of the package assembly of FIG. 7 is assembled.
Figure 9:
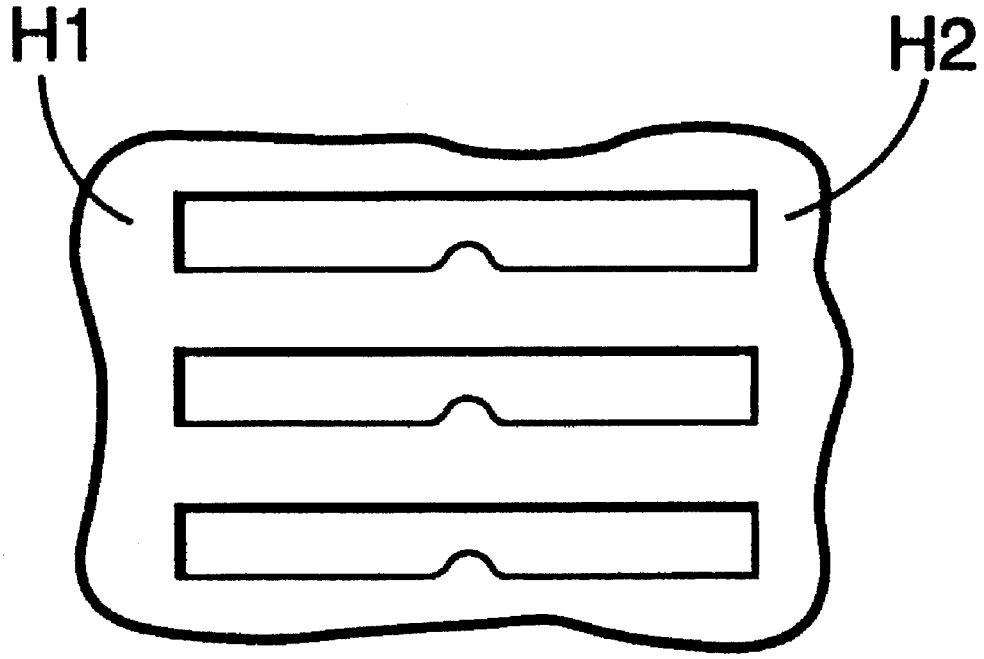
FIG. 9 illustrates first and second holding walls H1 and H2 that are parallel to one another.

FIGS. 7 and 8 illustrate a second alternative embodiment of a packaging assembly generally designated by the reference character 80 which has many parts that are essentially the same as the parts of the assembly 10 and which have been identified by the same reference characters to which the suffix "A" has been added.

Like the packaging assembly 10, the packaging assembly 80 comprises an elongate bottom box portion 22A having a longitudinal axis comprising three axially elongate bottom side walls 23A, 24A, 25A each having inside 26A and outside 27A surfaces, opposite first 28A and second 29A ends and opposite edges 30A.

Each of the bottom side walls 23A, 24A or 25A are joined along at least one of its edges 30A to the edge 30A of another of the side walls 23A, 24A or 25A to form a tubular or elongate main portion 32A of the bottom box portion 22A. The bottom box portion 22A also includes a pair of bottom end walls 82 disposed generally radially of the bottom box portion axis and attached adjacent the first 28A and second 29A ends of the side walls 23A, 24A and 25A.

Top cover means 5A for enclosing the elongate main portion 32A of bottom box portion 22A are also present in packaging assembly 80 and comprise an elongate top box portion comprising three elongate top side walls 3 each having inside and outside surfaces, opposite ends and opposite edges. Each of the top side walls 3 are joined along at least one of its edges to the edge of another of the top side walls 3. The top cover means 5A also include a pair of top end walls 7 disposed generally perpendicular to the side walls 3 and attached to the side walls 3 adjacent their ends. The inside surfaces of top cover means 5A are adapted to frictionally engage the outside surfaces 27A of bottom box portion 22A to enclose the elongate main portion 32A of bottom box portion 22A and to protect back-up pads 12. A length of pressure sensitive adhesive coated tape (not shown) that is adhesively attached to side walls 3 and elongate bottom box portion 22A may be used to secure the assembly together.

The packaging assembly 80 also includes a rack portion 84 having first 85 and second 86 holding walls separated by score line S. The first and second holding walls 85 and 86 are preferably disposed at an angle relative to one another and are preferably disposed at an angle relative to the side walls 23A, 24A and 25A of the bottom box portion 22A. The rack portion 84 is situated within the elongate main portion 32A of the bottom box portion 22A. The first and second holding walls 85 and 86 for the V-shaped rack portion 84.

Also like the packing assembly 10, in the packaging assembly 80, the rack portion 84 has a plurality of spaced surfaces forming slots 44A corresponding to the shape of a back-up pad (e.g. 12). For example, the slots 44A may be similar to the slots 44 or 44'.

Unlike the packaging assembly 10, in the packaging assembly 80, the rack portion 84 comprises the edge 87 of second holding wall 86 joined to bottom side wall 25A, and the edge 88 of first holding wall 85 joined to a tuck flap 89. The tuck flap 89 has a pair of edges 90, and is adapted to frictionally engage an inner surface 26A of bottom side wall 23A.

Like the packaging assembly 10, the packaging assembly 80 includes the three bottom side walls 23A, 24A and 25A disposed such that two 23A and 25A are generally parallel to each other and one 24A is generally perpendicular to the parallel bottom side walls 23A and 25A. Unlike the bottom end walls 34, the bottom end walls 82 each comprise a pair of end flaps 91 each attached to the ends 28A and 29A of the parallel bottom end walls 23A and 25A, and a foldable fastening flap 92 attached to the ends 28A and 29A of the bottom side wall 24A. The fastening flaps 92 are foldable to enclose the pair of end flaps 91 to form the bottom box portion 22A shown in FIG. 7. The fastening flaps 92 having a tab 93 at one end that is adapted to engage a notch 94 in bottom side wall 24A to lock the fastening flap 92 in the position shown in FIG. 7.

Optionally, the packaging assembly 80 may includes means for displaying the back-up pads 12 in a vertical position comprising slits 102 and score line 103 forming a hanging tab 104. The tab 104 may be bent along score line 103 and may include a hole 105 for engaging display hanging hooks (not shown) for hanging the packaging assembly 80 in the vertical display position (not shown). A finger hole F' may also be present in the blank shown in FIG. 8 to afford a user access to the tab 104.

EXAMPLE 2

The packaging assembly 80 shown in FIG. 7 may be conveniently and efficiently assembled from the unitary or monolithic blank shown in FIG. 8. The material used to construct the blank comprises a Kraft Fibre Material e.g. #200 Mullen strength, single wall corrugated board material (also known as Double Faced) having a B type "flute" or corrugation with about 47±3 flutes per foot with each flute about 3/32 inches in height.

The sides 23A, 24A and 25A of the blank have an overall axial length of approximately 17 inches (43.2 centimeters), and the width of the wall 24A is approximately 6 inches, (15.2 centimeters). The holding walls 85 and 86 each have an overall width of about 3 and 7/16 inches (8.6 centimeters). The width of the side walls 23A and 25A is approximately 4 and 3/16 inches. The foldable fastening flap 92 has an overall length of about 10 and 5/8 inches and the flaps 91 have a length of about 2 and 15/16 inches and a width of about 5 and 3/16 inches.

The slots 44A are cut in the shape according to the shape of back-up pad (e.g. 11 or 12). The slots 44A may have an outer diameter of 5 and 3/8 inches, an inner diameter of about 4 inches, and a width of about 0.75 inches. Several Stikit™ 4 inch Blue Vinyl Face back-up pads, Part No. 81672, generally available from Minnesota Mining and Manufacturing Company, of St. Paul, Minn. may be used in conjunction with the package described in this example.

To form the shape of the assembly 80 shown in FIG. 7, the end flaps 91 are bent along ends 28A and are positioned between portions of foldable fastening flap 92. The flap 92 is then self-locked by engaging tab 93 in notch 94. Next, the blank may be bent along score line S and along scores along edges 30A. Optionally the scores along edges 30A may comprise perforations. The tuck flap 89 may then be bent along edge 88 and positioned so that it engages an inner surface 26A of side wall 23A to complete the shape shown in FIG. 7.

After the blank is bent into the shape shown in FIG. 7, the inner surfaces of top cover means 5A may be slipped over outer surfaces 27A of bottom box portion 22A to complete the assembly 80. A length of pressure sensitive adhesive coated tape may optionally be used to secure the sidewalls 3 to the bottom box portion 22A.

The present invention has now been described with reference to several embodiment thereof. It will be apparent to those skilled in the art that many changes can be made in the embodiments described without departing from the scope of the present invention. For example, in the embodiment shown in FIGS. 7 and 8, the first and second holding walls need not be situated at an angle relative to one another and may instead be generally co-planar. Also, the package assembly may hold back-up pads having shapes other than the illustrated disc and frusto-conically disc shapes. For example, rectangular back-up pads may be stored and displayed according to the present invention. Thus, the scope of the present invention should not be limited to the structure described in this application, but only by structures described by the language of the claims and the equivalents of those structures.

What is claimed is:

1. In combination, a plurality of back-up pads having a generally disc shaped resilient portion, a circular front surface for having abrasive means attached thereto, and a circular rear surface with structure adjacent thereto for attaching the back-up pad to a source of power, each of said back-up pads having a shape, and a package for enclosing and protecting said plurality of back-up pads;

said package comprising:

an elongate bottom box portion having a longitudinal axis comprising:

three axially elongate bottom side walls each having inside and outside surfaces, opposite first and second ends and opposite edges, each of said bottom side walls being joined along at least one of its edges to the edge of another of said side walls to form an elongate main portion of said bottom box portion, and a pair of bottom end walls disposed generally radially of said bottom box portion axis and adjacent the first and second ends of said side walls; and a rack portion having first and second holding walls disposed at an angle relative to one another and disposed at an angle relative to the side walls of the bottom box portion, said rack portion being disposed within said elongate main portion of said bottom box portion, said rack portion having a plurality of spaced surfaces forming slots that are sized and shaped to afford engagement with surfaces of the back-up pads to retain a spaced relationship between back-up pads and between said back-up pads and said bottom box portion, said plurality of back-up pads being received in said slots; and top cover means for covering the elongate main portion of said bottom box portion.

2. A combination according to claim 1 wherein said first and second holding walls have edges and said rack portion comprises a package insert adapted to be disposed within said elongate main portion of said bottom box portion, said insert comprising said first and second holding walls and including a pair of side flaps each having first and second opposite major side surfaces, a pair of ends and edges, said flaps being joined to said first and second holding walls along their edges, wherein said flaps are foldable between a first protection position with the first major surfaces of said flaps facing each other to form a generally W-shaped insert, and a second display position with the first major surface of one flap facing the second major surface of the other flap to form a generally elongate structure with a longitudinal axis and a triangular cross-section that is adapted to display the back-up pads.

3. A combination according to claim 2 wherein one of said flaps has a pair of slits adjacent a middle portion of each of its ends to form a locking tab, and the other flap has a pair of locking slots adjacent a middle portion of each of its ends, wherein when said flaps are folded to the display position, said locking tabs may be bent to engage said locking slots to lock said flaps in said display position.

4. A combination according to claim 2 further including means for displaying said insert in a vertical position.

5. A combination according to claim 4 wherein said means for displaying said insert in a vertical position comprises each of said flaps having a pair of holes extending between said first and said second major side surface.

6. A combination according to claim 2 wherein one of said flaps has slits forming a foldable indicator member comprising a base portion and an indicia portion, wherein when said flaps are folded to said second display position, said indicator member may be folded between a vertical display position with the indicator member being generally parallel to said axis of said insert and a horizontal display position with said base portion parallel to said axis of said insert and said indicia portion being generally perpendicular to said axis of said insert.

7. A combination according to claim 6 wherein said indicator member includes means for retaining said indicator member in said vertical or horizontal display position comprising said base portion having slits forming a base portion tab that is adapted to engage a locking slot that is adjacent a middle portion of the end of one of said flaps.

8. A combination according to claim 6 wherein said indicator member includes means for retaining said indicator member in said horizontal display position comprising said indicia portion having slits defining an indicator member locking tab, and said first and second holding walls having a slit and a bend score for forming a rack locking slot wherein said indicator member locking tab may be bent to engage the rack locking slot to retain said indicator member in said horizontal display position.

9. A combination according to claim 1 wherein said first and second holding walls have a pair of opposite edges and said rack portion comprises:

a tuck flap having a pair of edges, and said first and second holding walls joined to an edge of one of said bottom side walls along one of said holding walls' edges, and said holding walls being joined to said tuck flap along the other of said holding walls' edges, wherein the tuck flap affords frictional engagement with an inner surface of one of said bottom side walls.

10. A combination according to claim 1 wherein said three bottom side walls are disposed such that two are generally parallel to each other and one is perpendicular to the parallel bottom side walls, and said pair of bottom end walls each comprise:

a pair of end flaps each attached to the ends of said parallel bottom end walls, and a foldable fastening flap attached to the end of said bottom side wall that is perpendicular to the parallel bottom side walls, said fastening flap being foldable to enclose said pair of end flaps, and said fastening flap having a tab at one end for engaging a notch in said bottom side wall that is perpendicular to said parallel bottom side walls to assemble said bottom box portion.

11. A combination according to claim 1 wherein said top cover means for enclosing the elongate main portion of said bottom box portion comprises a plurality of cover panels with at least one cover panel attached along an edge of said bottom side walls and at least one cover panel attached along an edge of said bottom end walls, and a length of pressure sensitive adhesive tape attached between the cover means and said elongate bottom box portion.

12. A combination according to claim 1 wherein said top cover means for enclosing the elongate main portion of said bottom box portion comprises an elongate top box portion comprising three elongate top side walls each having inside and outside surfaces, opposite ends and opposite edges, each of the top side walls being joined along at least one of its edges to the edge of another of the top side walls, and the top cover means further including a pair of top end walls disposed generally perpendicular to the side walls and attached to the side walls adjacent their ends.

13. In combination, a plurality of back-up pads having a resilient portion with a front surface for having abrasive means attached thereto, and a rear surface with structure adjacent thereto for attaching the back-up pad to a source of power, each of said back-up pads having a shape, and a package for enclosing and protecting said plurality of back-up pads;

said package comprising:

an elongate bottom box portion having a longitudinal axis comprising:

three axially elongate bottom side walls each having inside and outside surfaces, opposite first and second ends and opposite edges, each of said bottom side walls being joined along at least one of its edges to the edge of another of said side walls to form an elongate main portion of said bottom box portion, and a pair of bottom end walls disposed generally radially of said bottom box portion axis and generally adjacent the first and second ends of said side walls; and a rack portion having first and second holding walls, said rack portion being disposed adjacent said elongate main portion of said bottom box portion, said rack portion having a plurality of spaced surfaces forming slots that are sized and shaped to afford engagement with surfaces of the back-up pads to retain a spaced relationship between back-up pads, said back-up pads being received in said slots; and top cover means for enclosing the elongate main portion of said bottom box portion.

14. A combination according to claim 13 wherein said first and second holding walls are parallel to one another.

15. A combination according to claim 13 wherein said first and second holding walls have edges and said rack portion comprises a package insert adapted to be disposed within said elongate main portion of said bottom box portion, said insert comprising said first and second holding walls and including a pair of side flaps each having first and second opposite major side surfaces, a pair of ends and edges, said flaps being joined to said first and second holding walls along their edges, wherein said flaps are foldable between a first protection position with the first major surfaces of said flaps facing each other to form a generally W-shaped insert, and a second display position with the first major surface of one flap facing the second major surface of the other flap to form a generally elongate structure with a longitudinal axis and a triangular cross-section that is adapted to display the back-up pads.

16. A combination according to claim 15 wherein one of said flaps has a pair of slits adjacent a middle portion of each of its ends to form a locking tab, and the other flap has a pair of locking slots adjacent a middle portion of each of its ends, wherein when said flaps are folded to the display position, said locking tabs may be bent to engage said locking slots to lock said flaps in said display position.

17. A combination according to claim 15 wherein one of said flaps has slits forming a foldable indicator member comprising a base portion and an indicia portion, wherein when said flaps are folded to said second display position, said indicator member may be folded between a vertical display position with the indicator member being generally parallel to said axis of said insert and a horizontal display position with said base portion parallel to said axis of said insert and said indicia portion being generally perpendicular to said axis of said insert.

18. A combination according to claim 13 wherein said first and second holding walls have a pair of opposite edges and said rack portion comprises:

a tuck flap having a pair of edges, and said first and second holding walls joined to an edge of one of said bottom side walls along one of said holding walls' edges, and being joined to said tuck flap along the other of said holding walls' edges, wherein the tuck flap affords frictional engagement with an inner surface of one of said bottom side walls.

19. A combination according to claim 13 wherein said three bottom side walls are disposed such that two are generally parallel to each other and one is perpendicular to the parallel bottom side walls, and said pair of bottom end walls each comprise:

a pair of end flaps each attached to the ends of said parallel bottom end walls, and a foldable fastening flap attached to the end of said bottom side wall that is perpendicular to the parallel bottom side walls, said fastening flap being foldable to enclose said pair of end flaps, and said fastening flap having a tab at one end for engaging a notch in said bottom side wall that is perpendicular to said parallel bottom side walls to assemble said bottom box portion.

20. In combination, a plurality of back-up pads having a generally disc shaped resilient portion, a circular front surface for having abrasive means attached thereto, and a circular rear surface with structure adjacent thereto for attaching the back-up pad to a source of power, each of said back-up pads having a shape, and a package comprising:

an elongate bottom box portion having a longitudinal axis comprising:

three axially elongate bottom side walls each having inside and outside surfaces, opposite first and second ends and opposite edges, each of said bottom side walls being joined along at least one of its edges to the edge of another of said side walls to form an elongate main portion of said bottom box portion, and a pair of bottom end walls disposed generally radially of said bottom box portion axis and adjacent the first and second ends of said side walls; and a rack portion having first and second holding walls being disposed within said elongate main portion of said bottom box portion, said rack portion having a plurality of spaced surfaces forming slots corresponding to the shapes of each of said back-up pads, said surfaces forming said slots affording engagement with surfaces of the back-up pads to retain a spaced relationship between back-up pads and between said back-up pads and said bottom box portion, and top cover means for enclosing the elongate main portion of said bottom box portion.

* * * * *